United States Patent [19]

Kowalik et al.

[11] Patent Number: 4,821,641

[45] Date of Patent: Apr. 18, 1989

[54] DAMPENING AND BRIDGING APPARATUS FOR A DUPLICATING MACHINE

[75] Inventors: Matthew F. Kowalik, Wheeling; Chester S. Rempala, Chicago, both of Ill.

[73] Assignee: A. B. Dick Company, Chicago, Ill.

[21] Appl. No.: 152,663

[22] Filed: Feb. 5, 1988

[51] Int. Cl.[4] ..... B41L 25/14

[52] U.S. Cl. ..... 101/148; 101/349; 101/352

[58] Field of Search ..... 101/148, 349, 350, 352, 101/145

[56] References Cited

U.S. PATENT DOCUMENTS

| | | | |
|---|---|---|---|
| 2,929,316 | 3/1960 | Fowlie | 101/148 |
| 3,538,849 | 11/1970 | Bohman | 101/352 |
| 3,559,569 | 2/1971 | Jurny | 101/148 |
| 3,603,254 | 9/1971 | Siebke | 101/148 |
| 4,130,057 | 12/1978 | List et al. | 101/148 |
| 4,290,360 | 9/1981 | Fischer | 101/148 |
| 4,351,236 | 9/1982 | Beisel et al. | 101/148 |
| 4,676,156 | 6/1987 | Aylor et al. | 101/148 |
| 4,703,690 | 11/1987 | Keller | 101/148 X |
| 4,724,764 | 2/1988 | MaePhee et al. | 101/148 X |

FOREIGN PATENT DOCUMENTS

| | | | |
|---|---|---|---|
| 0087730 | 9/1983 | European Pat. Off. | 101/375 |
| 3641013 | 10/1987 | Fed. Rep. of Germany | 101/148 |

*Primary Examiner*—Edgar S. Burr
*Assistant Examiner*—James Lisehora
*Attorney, Agent, or Firm*—Jones, Day, Reavis & Pogue

[57] ABSTRACT

A bridging roller is disposed between the upper form roller of the inking system and the dampening form roller of the dampening system. The bridging roller's mounting means are offset from the axis of rotation of the bridging roller such that selective orientation of the mounting means allows the system to be quickly and easily changed over between the integrated and segregated modes. In the dampening system the oscillating roller and form roller are supported on a pivotable support structure such that the dampening form roller can be moved out of engagement with the master cylinder and the oscillating roller can be simultaneously moved out of engagement with the metering roller to facilitate start up of the printer. When the rollers are in this start-up position the oscillating roller can be independently moved to a remote position to facilitate cleaning of the printer.

4 Claims, 4 Drawing Sheets

DAMPENING AND BRIDGING APPARATUS FOR A DUPLICATING MACHINE

BACKGROUND OF THE INVENTION invention relates, generally, to the bridging and dampening systems used in duplicating machines, for example, offset-type presses. As is well-known in the art, the typical offset duplicator includes a master cylinder which carries a master or printing plate having ink receptive image areas and repellant solution or water receptive background areas formed thereon. Ink is transferred to the master by the inking system, and repellant solution is transferred to the master by the dampening system. The ink receptive image on the master plate retains the ink while the non-image areas of the master plate are receptive to the repellant solution and repel the ink.

A blanket cylinder is rotatably engaged with the master cylinder and has a blanket adapted to receive an offset, inked image from the master plate. A rotatable impression cylinder contacts the blanket cylinder such that a sheet of paper can be fed therebetween. As the paper passes between the blanket cylinder and impression cylinder, the latter applies pressure upwardly against the sheet such that the image from the blanket cylinder is transferred to the sheet of paper.

An exemplary dampening system may include a fountain roller, partially immersed in the repellant solution, which contacts and delivers the repellant solution to a metering roller. The metering roller, contacts and delivers the repellant solution to a dampening form roller which, in turn, contacts the master or printing plate on the master cylinder to transfer the repellant solution thereto.

An exemplary inking system may include an ink fountain roller, partially immersed in ink held by an ink fountain, which contacts and transfers ink to an oscillating roller. The oscillating roller reciprocates along its axis of rotation as it rotates to thereby ensure that the ink is evenly spread over the roller's surface. The ink is transferred, through a series of transfer rollers, to inking form rollers which contact the master cylinder to supply ink to the master or printing plate.

Each time the ink passes through the area between the nip of two rollers, it is split such that a portion of the ink adheres to each roller. As is well known in the art, the printing capability of the ink is improved each time it passes through a nip. The splitting of the ink at the nip gives a thinner and more uniformly distributed layer of ink on the rollers and the pressure applied to the ink at the nip by the rotating rollers makes the ink more pliable. Because these inking characteristics result in a higher quality printed product, it is desirable to maximize the number of rollers in the ink path and, therefore, increase the nips through which the ink passes before being applied to the master plate.

One way of maximizing the number of nips in the system is to increase the number of transfer rollers in the inking system. However, due to size constraints the number of rollers that can be included in the ink path is limited. In order to overcome this limitation, the inking system and dampening system can be connected with one another by a bridging system to create what is known in the art as an integrated system. In the integrated system the ink is delivered to the master or plate along a path that includes a portion of the dampening system. Thus, the number of nips through which the ink passes is increased by addition of the rollers to the ink path in the dampening and bridging systems.

While the integration of the inking and dampening systems results in the delivery of a higher quality ink to the master plate, it is desirable at times to run the inking system separately from the dampening system in a, so-called, segregated mode. Typically, the segregated mode is used for very fine line work where a less viscous ink is preferred. Therefore, there is a need for a printer which can be quickly and easily changed over between the integrated and segregated modes.

U.S. Pat. No. 4,676,156 to Aylor et al. shows a known dampening apparatus for an offset printer. The inking supply is shown integrated with the dampening system through a distribution roller. The distribution roller is supported on pivotable brackets such that contact between the distribution roller and the applicator roller of the inking system can be interrupted. A set screw and slot arrangement secures the pivotable brackets and in the desired position.

The bridging system 63 and dampening system 31 of the present invention are shown in association with a known inking system in FIG. 1. When the inking system shown in FIG. 1 is used with the dampening system of Aylor et al., the ink that is transferred directly to the distribution roller will be transferred to the dampening system even in the segregated mode because the distribution roller never breaks contact with the applicator roller of the dampening system. Thus, the Aylor et al. dampening system, when used in conjunction with the inking system shown in FIG. 1, would not operate in a truly segregated mode. Moreover, because some ink would be transferred to the dampening system through the distribution roller and the inking form rollers, and thus would not receive a full supply of ink. An additional drawback of the arrangement shown by Aylor et al. is the time and expertise required to release, fasten, and properly locate the set screws when changing between the integrated and segregated modes. Moreover, specialized tools are necessary to loosen and tighten the set screws. Thus, a more convenient method for changing between the integrated and segregated modes is desired.

West German Patent DE No. 3,641,013 issued to Jentzsch et al. shows a printing machine in which the inking and dampening systems can be selectively integrated and segregated. The inking form roller and dampening form roller can also be selectively engaged or disengaged from the master cyclinder. However, the means for moving the rollers into and out of engagement with one another consists of a complicated system of linkages and a cam/cam follower arrangement. As a result, the system is not adapted for the ease of manual positioning of the rollers as is the case with the present invention. Moreover, such a complicated system requires numerous fine adjustments to accurately position the rollers.

In addition to the ability to be able to change between the integrated and segregated modes, it is also necessary to be able to move the applicator form roller of the dampening system out of contact with the master cylinder so as to be able to remove and replace the master plate. While Aylor and Jentzsch et al. discloses such a capability, the mechanisms for performing this function are cumbersome to operate.

Moreover, the known prior art devices do not provide a simple and effective way to isolate the fountain roller and metering roller from the remainder of the system to allow the metering roller to be prewet with repellant solution prior to transferring ink thereto. As a result, the start up of the printer is complicated by the difficulty of prewetting the metering roller.

Finally, the known prior art devices do not provide a simple and effective way of isolating the inking system and the dampening form roller from the remainder of the system to facilitate the clean up operation. As a result, in the known systems the components must be individually cleaned.

BRIEF DESCRIPTION OF THE INVENTION

In order to overcome the above-noted shortcomings of the prior art, the dampening and bridging systems of the present invention have been developed. A bridging roller is disposed between one form roller of the inking system and the form roller of the dampening system. The bridging roller's mounting means are offset from the axis of rotation of the bridging roller such that selective orientation of the mounting means allows the system to be quickly and easily changed over between the integrated and segregated modes.

The dampening system includes a fountain roller, metering roller, and applicator form roller comparable to those found in the prior art devices. In addition to these rollers a self-oscillating roller is disposed between the metering roller and the dampening form roller. The self-oscillating roller and dampening form roller are supported on a pivotable support structure such that the dampening form roller can be moved out of engagement with the master cylinder and the self-oscillating roller can be simultaneously moved out of engagement with the metering roller. In this position the master cylinder can be accessed to remove and replace the master plate and the metering roller can be prewet with repellant solution prior to ink being transferred thereto to thereby facilitate the start-up of the printer. When the rollers are in this start-up position the self-oscillating roller can be independently moved to a remote position to facilitate the cleaning of the ink carrying components of the printer.

OBJECTS OF THE INVENTION

It is a general object of the invention to provide an improved dampening and bridging system for an offset-type printer.

It is a further object of the invention to provide a dampening system in which a portion of the dampening system roller train can be isolated simply and easily from the rest of the system by moving the oscillating roller and dampening form roller to thereby facilitate the start-up operation.

It is a still further object of the invention to provide a dampening system in which the dampening form roller can be quickly and easily separated from the master cylinder.

It is another object of the invention to provide a dampening system roller train having an additional oscillating roller that can be independently moved to a position whereby clean up of the system is facilitated.

It is yet another object of the invention to provide a bridging system in which the bridging roller can be quickly and easily changed over between the integrated and segregated modes.

Other objects of the invention, in addition to those set forth above, will become apparent to one of ordinary skill in the art from the following description.

DETAILED DESCRIPTION OF THE INVENTION

Overview of the Offset Duplicating Apparatus

Figure 1:
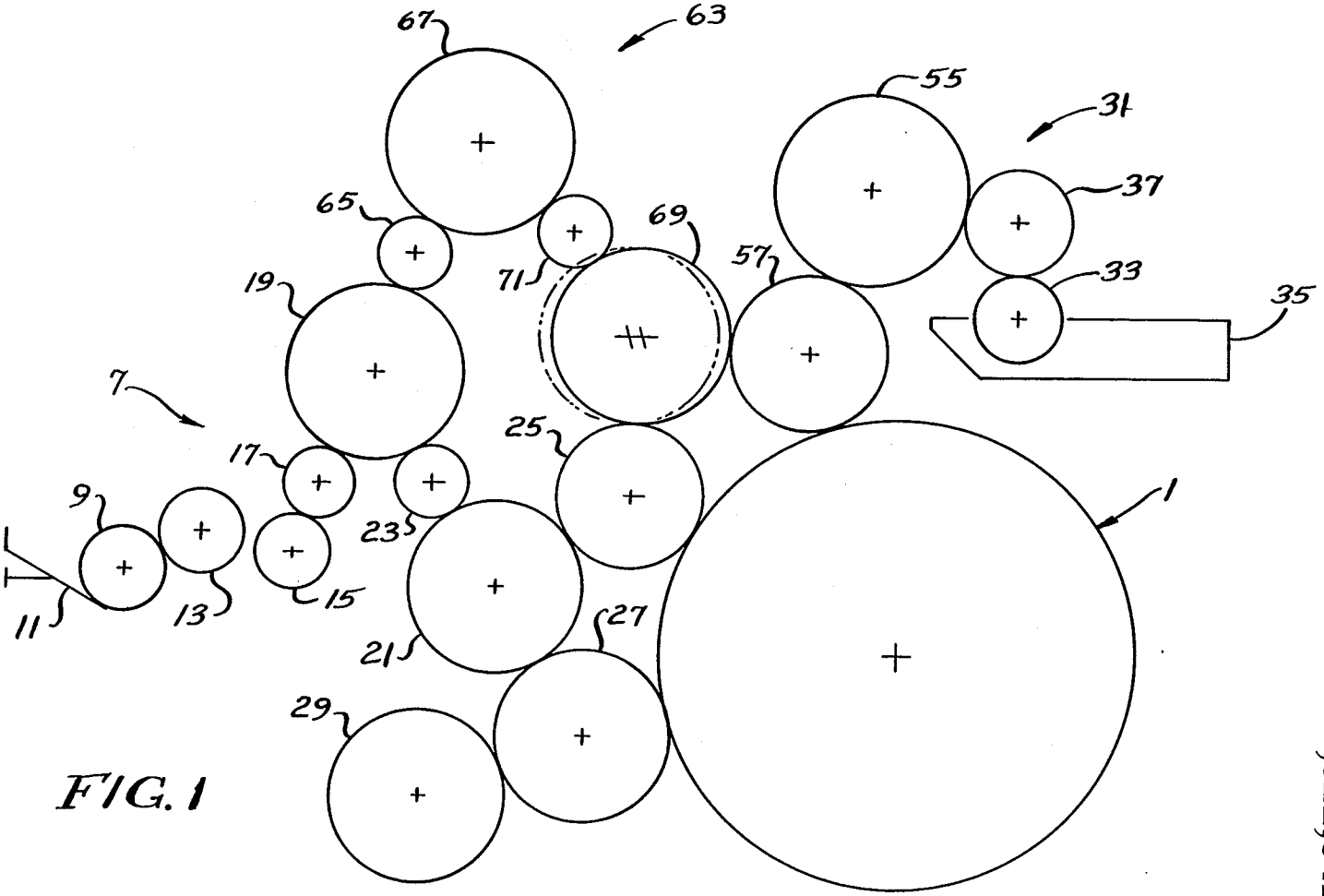
FIG. 1 shows a schematic side view of the dampening and bridging systems of the invention.

The duplicating equipment of the invention is shown schematically in FIG. 1 and includes a master cylinder 1 having a surface for removably supporting a printing plate (not shown) as is well-known in the art. The printing plate is supplied with repellant solution from the dampening system 31 which adheres to the background areas and is supplied with ink from the inking system 7 which adheres to the image areas. The inked image on the plate is transferred to a blanket supported by and stretched over the surface of a blanket cylinder (not shown). In a manner well-known to those skilled in the art, an impression cylinder (not shown) is rotatably supported adjacent the blanket cylinder for periodical movement toward the latter to press a piece of paper against the blanket as the paper is drawn between the blanket and impression cylinders to transfer the inked image to the paper.

The inking system 7, shown in FIG. 1, includes a fountain roller 9, for example, partially immersed in ink in an ink pan 11. A ductor roller 13, distribution roller 15, and a rider roller 17 to transfer the ink from the fountain roller 9 to a first oscillating roller 19. First oscillating roller 19 supplies the ink to a main oscillating roller 21 via a rider 23. The main oscillating roller 21 transfers the ink to an upper form roller 25 and a lower form roller 27 which, in turn, apply the ink directly to the plate on the master cylinder 1. A dry oscillating roller 29, so-called because it does not deliver ink, contacts the lower form roller 27 to evenly spread the ink over the surface of the lower form roller 27.

Figure 5:
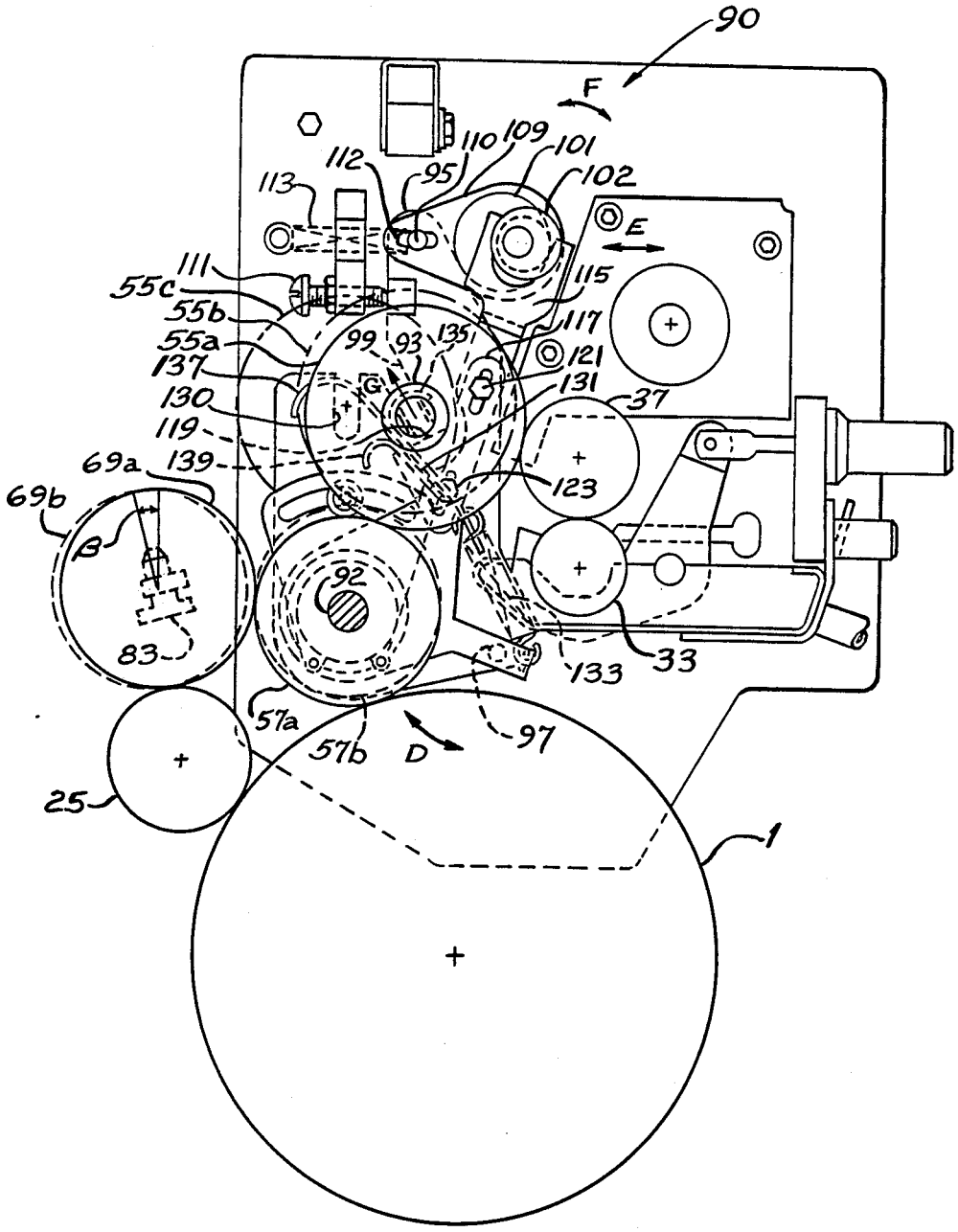
FIG. 5 shows a more detailed side view of the dampening system of the invention.
Figure 6:
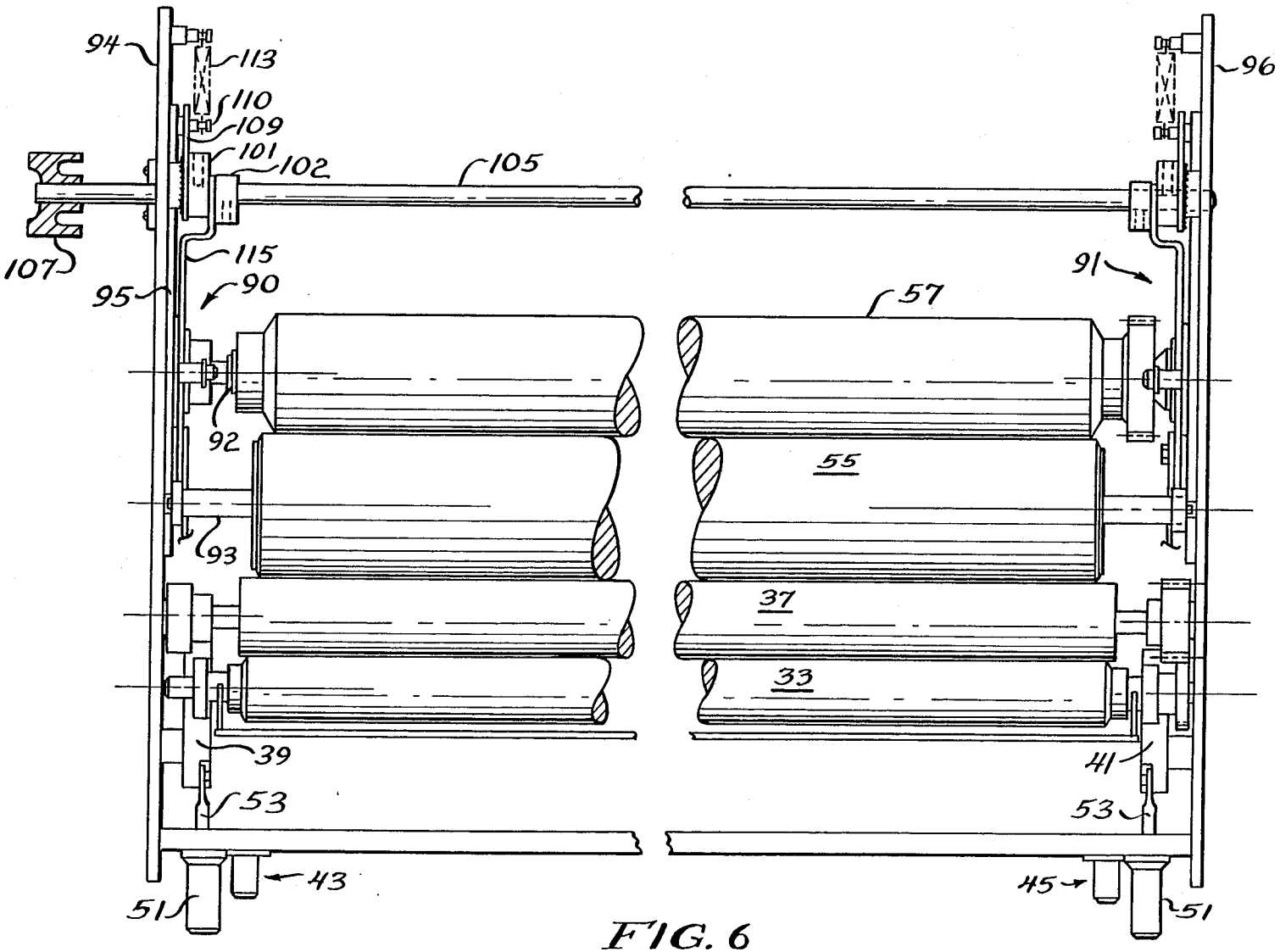
FIG. 6 shows a developed section view of the dampening system of the invention.

The dampening system 31, shown in FIG. 1, includes a fountain roller 33 exemplary partially immersed in repellant solution in pan 35, though, as is well known in the art such solution may be provided by a spray or brush. Fountain roller 33 is in continuous contact with a metering roller 37 and transfers repellant solution thereto. The surface of the metering roller 37 is intentionally provided with hydrophilicity, for example by being chrome-plated or formed of stainless steel, such that ink does not adhere thereto. Fountain roller 33 is supported at its opposite ends by pivotable linkages 39 and 41 as shown in FIGS. 5 and 6. The linkages are pivoted by linear actuators 43 and 45, respectively, such that the pressure between the fountain roller 33 and metering roller 37 can be controlled. The linear actuators 43 and 45 each consist, preferably, of a manually rotable knob 51 having screw threads that engage mating screw threads formed on link 53 whereby the link and linkages 39 and 41 are pivoted. As the pressure between these rollers increases the amount of repellant delivered to the system decreases and vice-versa.

Referring to FIG. 1, metering roller 37 delivers the repellant solution to oscillating roller 55. Oscillating roller 55 is of the self-oscillating type and includes a well-known internal camming structure which oscillates the roller along its axis of rotation as it rotates to evenly distribute the repellant solution and ink over the surface of the roller. The oscillating roller 55 transfers the ink and repellant solution to the dampening form roller 57 which, in turn, transfers the ink and repellant solution to the image plate of the master cylinder 1.

The Bridging System

A bridging system, shown generally at 63 in FIG. 1, integrates the dampening system 31 with the inking system 7 and includes a rider 65 contacting the first oscillating roller 19 and the bridge oscillating roller 67. The bridge oscillating roller 67 is of the self-oscillating type and transfers ink to the bridging roller 69 (which also oscillates as explained subsequently) via rider 71. The bridging roller 69 contacts both the upper form roller 25 of the inking system 7 and the dampening form roller 57 of the dampening system 31 to transfer ink and repellant solution therebetween when the system is operating in the integrated mode as illustrated, in the solid line position 69*a* of FIG. 5.

Figure 2:
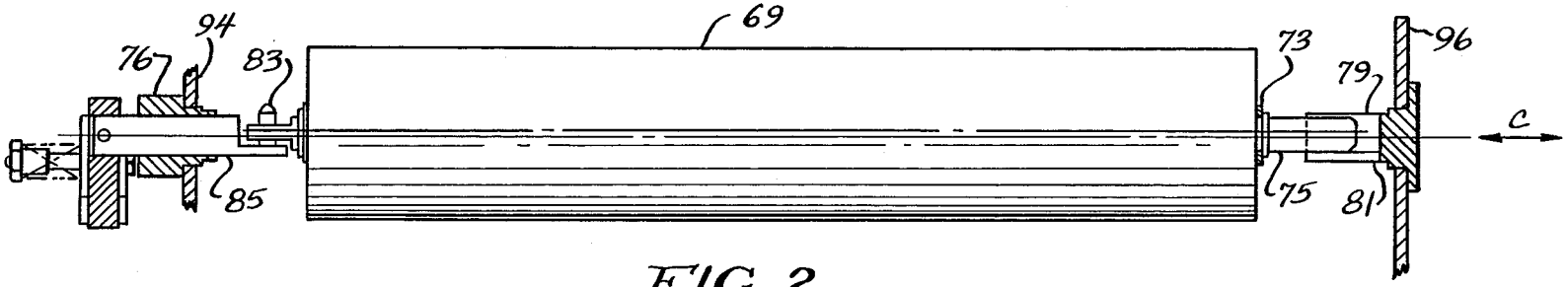
FIG. 2 shows a side view of the bridging roller.
Figure 3:
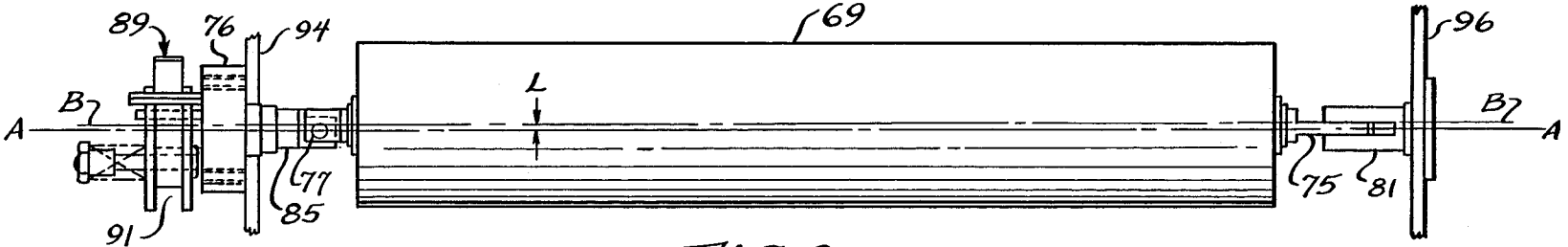
FIGS. 3 and 4 show top views of the bridging roller in the integrated and segregated modes, respectively.
Figure 4:
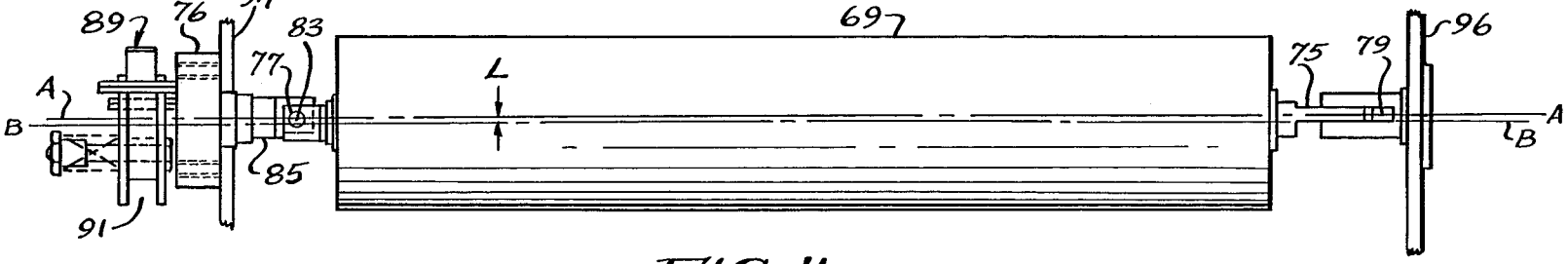

In accordance with the present invention the bridging roller 69 is rotatably journaled on a shaft 73 one end of which is formed as a flat stub shaft 75 and the other end of which includes an aperture 77 as shown in detail in FIGS. 2, 3 and 4. The center of aperture 77 and the axis of stub shaft 75 are located along a line A—A that is offset from the axis of rotation B—B of the roller 69 by distance L.

The stub shaft 75 is slidably received in slot 79 of roll guide 81 and the aperture 77 receives a tang 83 formed on coupler assembly 85. The coupler assembly 85 is slidably received within a coupling guide 76 and is keyed therein to prevent rotation of the coupler assembly 85 within the guide 76. Fixed to the opposite end of the coupler assembly 85 from the tang 83 is a cylindrical member 89 formed with channel 91. Channel 91 is engaged by a camming finger (not shown) which oscillates along the axis of rotation of the roller as represented by arrow C as is well-known in the art. The coupler assembly 85 transmits this oscillating motion to the bridging roller 69 such that the roller oscillates in either direction, as depicted by arrow C, as it rotates. It should be noted that the slot 79 is of sufficient length to allow the stub shaft 75 to reciprocate therein.

To change from the integrated mode, shown in solid line 69*a* in FIG. 5, to the segregated mode, shown in dashed line 69*b* in FIG. 5, the bridging roller 69 is manually removed from the roll guide 81 and coupler assembly 85 (see FIG. 4). The shaft 73 is then rotated 180° along its longitudinal axis and replaced on the roll guide 81 and coupler assembly 85 as shown in FIG. 3. Because of the amount of the offset distance L the bridging roller 69 is spaced from the dampening form roller 57 as shown in dashed line position 69*b* in FIG. 5 such that the system operates in the segregated mode.

The bridging roller 69 maintains contact with the upper inking form roller 25 in both the integrated and segregated modes as illustrated in FIG. 5. In order to ensure that this contact is maintained, the tang 83 and the slot 79 are canted relative to the vertical by an angle $\beta$ of approximately 15° as shown in FIG. 5. As a result, the weight of the roller 69 is directed along the canted direction toward the upper form roller 25 such that contact is maintained between these two rollers due to the gravitational force on bridging roller 69.

When the bridging roller 69 is in the segregated position 69*b*, the inking system and dampening system are (except to the extent that both engage the printing plate) isolated from one another such that there is no direct transference of ink or solution via their respective roller trains. Moreover, the ink that is transferred directly to the bridging roller 69 by the bridging system 63 is recirculated back to the upper and lower inking form rollers 25 and 27, respectively. Finally, the offset design of the bridging roller mounting means provides a simple and convenient method for selectively integrating and segregating the system requiring no specialized tools.

Movable Support Structure for the Oscillating Roller and Form Roller of the Dampening System FIGS. 5 and 6 show the support structure for the oscillating roller 55 and dampening form roller 57 of the dampening system 31. The support structure moves oscillating roller 55 and dampening form roller 57 to isolate the metering roller 37 and fountain roller 33 from the rest of the system such that the start-up and clean-up operations are facilitated as will hereinafter be described.

FIG. 6 shows a first support structure 90 and a second support structure 91 arranged at opposite sidewalls 94 and 96 of the printer subframe for the dampening system. Each support structure supports one end of the dampening form roller shaft 92 and oscillating roller shaft 93 such that the two rollers are suspended therebetween. The support structures are of identical construction; therefore, specific reference will be made only with reference to support structure 90.

The support structure 90 includes a support plate 95 (shown in FIG. 6) pivotably supported at its lower right-hand corner (as viewed in FIG. 5) by shaft 97 mounted on sidewall 94 (shown in FIG. 5). Dampening form roller shaft 92 is fixedly supported in the support plate 95 and oscillating roller shaft 93 is slidably supported within a first grooved guideway 99 formed in plate 95. Shaft 93 is retained in the support plate 95 by retainer 131. Retainer 131 has a first end mounted to support plate 95 through a tension spring 133 and a second end consisting of three hooks 135, 137 and 139. Hook 135 encircles shaft 93 of the oscillating roller 55 to retain shaft 93 in guideway 99.

A first eccentric 101 and a second eccentric 102 are fixedly secured to a rotatable shaft 105 which extends between the sidewalls 94 and 96 of the aforementioned subframe. The shaft 105 has a knob 107 secured at one end thereof external to the printer frame. The knob 107 is manually rotated to rotate the eccentrics 101 and 102.

The first eccentric 101 is connected to the support plate 95 by link 109 through pin 110 and slot 112 such that rotation of the knob 107 results in substantially horizontal movement of link 109 and pin 110 in the direction of arrow E. As the link 109 moves in either of the directions represented by arrow E the support plate 95 is pivoted about shaft 97 in either direction of arrow D. As the plate 95 pivots clockwise (as viewed in FIG. 5), dampening form roller 57 is moved out of engagement with the master cylinder 1 as shown in the dotted line position 57*b* of FIG. 5. A counter-rotation of knob 107 rotates the applicator form roller 57 back into engagement with the printing plate on the master cylinder 1 as shown by the solid line position 57*a*. A stop member 111 limits the movement of support plate 95 so as to accurately position the form roller 57 against the master cylinder 1. In the preferred embodiment, the stop 111 is an adjustable set screw which abuts the edge of the support plate 95. A tension spring 113 is secured between the duplicator subframe and the pin 110 to maintain a predetermined pressure between the form roller 57 and the printing plate on the master cylinder 1.

A lever 115 is mounted at one end for pivotable movement about the shaft 92 of the dampening form roller 57. The other end of lever 115 is basically U-shape and engages the second eccentric 102. Adjustably mounted on lever 115, by set screws 121 and 123, is an abutment member 117 having a shoulder portion 119. The shoulder portion 119 contacts and supports the roller shaft 93.

When the second eccentric 102 is rotated, the lever 115 is pivoted about shaft 92 in either of the directions of arrow F. As the lever pivots counterclockwise (as viewed in FIG. 5), the shoulder portion 119 moves shaft 93 within the guideway 99, in the direction of arrow G, such that oscillating roller 55 is moved out of engagement with the metering roller 37 to the dotted line position **55*b* of FIG. 5. Shaft 93 is biased against shoulder portion 119 by the retainer 131 through the action of tension spring 133 to thereby constrain the movement of shaft 93 within the guideway 99**.

Thus, the rotation of knob 107 simultaneously causes the applicator form roller 57 to be moved out of engagement with the master cylinder and the oscillating roller 55 to be moved out of engagement with the metering roller 37. In this position, the printer operator can access the master cylinder 1 to remove and replace the image plate. Moreover, the printer can be started-up to prewet the hydrophilic surface of metering roller 37 with repellant solution from the fountain roller 33 prior to its engagement with the ink carrying oscillating roller 55. One of ordinary skill in the art will appreciate that prewetting of the metering roller is necessary to maintain its ability to repel the ink found on oscillating roller 55. Once the image plate has been replaced and the metering roller 37 prewet with repellant solution, the eccentrics 101 and 102 can be rotated back to their initial position to place the rollers back into contact with one another in the operative solid line position.

The support structure 90 of this invention also provides an additional capability for facilitating clean-up of the system once the rollers are in the disengaged position. The oscillating roller 55 is manually removed from the guideway 99 and placed in the alternate guideway 130 as shown in dotted line position **55*c*. In order to remove oscillating roller 55 from the guideway 99, the printer operator grasps hook 137 of retainer 131 and removes hook 135 from engagement with shaft 93. The shaft 93 is then manually located in guideway 130 and the hook 139 is manually moved into engagement therewith to retain roller 55 in position 55*c*. In this position the oscillating roller 55 is distanced further from the metering roller 37 to eliminate the possibility of the cleaning fluid contacting the metering roller. One of ordinary skill in the art will appreciate that the ability of the surface of the metering roller 37 to repel ink is destroyed when its surface is contaminated by cleaning fluids and the roller loses its hydrophilicity. Therefore, isolation of the metering roller during clean-up is essential. Moreover, the oscillating roller 55 when positioned in guideway 130, contacts the dampening form roller 57 which, in turn, is engaged with the inking system 7 and bridging system 63 via bridging roller 69**. Thus, all of the ink carrying rollers can be cleaned simultaneously by running cleaning fluid through the inking system without adversely affecting the surface of the metering roller.

Operation of the Dampening and Bridging Systems

Prior to start up of the printer, the printer operator manually orientates the bridging roller shaft 73 such that the bridging roller 69 assumes either the integrated or segregated mode. As previously discussed, the mode of operation and the corresponding orientation of shaft 73 will be dictated by the type of printing to be done. For example, the segregated mode is typically used for very fine line work. Once the proper positioning of the bridging roller 69 is accomplished the remaining rollers 65, 67 and 71 of the bridging system are manually located in their respective supports to complete the bridging system 63.

The operator also rotates knob 107 to move oscillating roller 55 to start-up position **55*b* and dampening form roller 57 to start-up position 57*b*. In this position dampening form roller 57 is spaced from the printing plate on master cylinder 1** such that the operator can access the master cylinder to attach thereto the master plate having the particular ink receptive image for the printing job to be performed.

The operator then starts the printer motor to begin rotation of the rollers of the dampening system 31 as is conventional in the art. Because oscillating roller 55 is in position **55*b* where it is spaced from metering roller 37, metering roller 37 can be prewet with repellant solution from fountain roller 33** prior to its engagement with any ink carrying rollers.

After the printing plate has been attached to the master cylinder 1 and the metering roller 37 has been prewet with repellant solution, the operator gives knob 107 a counter-rotation such that oscillating roller 55 is moved into engagement with metering roller 37 and dampening form roller 57 is moved into engagement with the printing plate on master cylinder 1. In this position the ink and repellant solution are transferred to the printing plate and the printing process is begun.

Once the printing process is completed, the knob 107 is once again rotated such that applicator form roller 57 is separated from master cylinder 1 and oscillating roller 55 is separated from metering roller 37. In this position the oscillating roller 55 can be manually moved by the operator from position **55*b* to position 55*c*, shown in FIG. 5, such that cleaning fluid can be run through the inking system, bridging system, and the ink carrying rollers 55 and 57** of the dampening system. Once all of these ink carrying rollers are cleaned the printer can be idled until another printing process is begun at which time the start-up operation is repeated.

Although the invention has been described in its preferred form with a certain degree of particularity, it is to be understood that the present disclosure has been made by way of example only. Numerous changes in the details and construction of the combination and arrangement of parts will be apparent without departing from the spirit and scope of the invention.

What is claimed is:

1. A bridging system for use with an offset printer of the type having a frame with opposed sidewalls supporting a master cylinder, a dampening system for transferring repellant solution to the master cylinder, an inking system for also transferring ink to the master cylinder, and a bridging roller rotatably supported by a shaft and movable between the dampening system and inking system, comprising:

a two-position bridging roller support for positively maintaining the bridging roller in either a first position in which the bridging roller cooperatively contacts a roller of the inking system and a roller of the dampening system to transfer ink and repellant solution therebetween or a second position in which the bridging roller remains in contact with the inking system roller but is spaced from the dampening system roller such that ink and repellant solution are not transferred therebetween, said bridging roller support including:

a mounting means for mounting the bridging roller shaft to the printer frame, said mounting means including a stub shaft at one end of the bridging roller shaft and the other end of the bridging roller shaft defining an aperture, the center of the aperture and the center of the stub shaft being located along a line offset a predetermined distance from the axis of rotation of said bridging roller, said bridging roller shaft being movable between a first orientation and a second orientation, and engaging means located on the opposed sidewalls for engaging said mounting means and supporting said bridging roller in either of said orientations;

whereby when said mounting means is in said first orientation said bridging roller is in said first position and when said mounting means is in said second orientation said bridging roller is in said second position.

2. The bridging system according to claim 1, wherein said engaging means includes a roll guide having a slot for receiving said stub shaft and a coupler assembly having a tang for engaging said aperture.

3. The bridging system according to claim 2, wherein said coupler assembly is slidably supported for reciprocating movement parallel to the roller shaft within a coupling guide.

4. The bridging system according to claim 2, wherein said tang and said slot are angled relative to the vertical.

* * * * *